US008941693B2

(12) United States Patent
Syed

(10) Patent No.: US 8,941,693 B2
(45) Date of Patent: Jan. 27, 2015

(54) METHOD AND APPARATUS FOR PROVIDING REDUCED POWER USAGE OF A DISPLAY INTERFACE

(75) Inventor: Athar Hussain Syed, Scarborough (CA)

(73) Assignee: ATI Technologies ULC, Markham, Ontario (CA)

( * ) Notice: Subject to any disclaimer, the term of this patent is extended or adjusted under 35 U.S.C. 154(b) by 993 days.

(21) Appl. No.: 12/553,430

(22) Filed: Sep. 3, 2009

(65) Prior Publication Data

US 2011/0050734 A1 Mar. 3, 2011

(51) Int. Cl.
*G09G 5/10* (2006.01)
*G09G 5/00* (2006.01)

(52) U.S. Cl.
CPC ..... *G09G 5/006* (2013.01); *G09G 2370/04* (2013.01)
USPC ..... 345/690

(58) Field of Classification Search
None
See application file for complete search history.

(56) References Cited

U.S. PATENT DOCUMENTS

2005/0066085 A1* 3/2005 Kobayashi ..... 710/62
2006/0280055 A1* 12/2006 Miller et al. ..... 369/44.11
2007/0222779 A1* 9/2007 Fastert et al. ..... 345/418
2008/0232209 A1* 9/2008 Vergoossen et al. ..... 369/47.5
2008/0291194 A1* 11/2008 Lee et al. ..... 345/213

OTHER PUBLICATIONS

Video Electronics Standards Association (VESA), "DisplayPort Overview".
Video Electronics Standards Association (VESA), "DisplayPort Technical Overview".

* cited by examiner

*Primary Examiner* — Nicholas Lee
(74) *Attorney, Agent, or Firm* — Faegre Baker Daniels LLP

(57) ABSTRACT

A method detects by a display driver logic, inactivity between the display driver logic and a display logic, and deactivates an auxiliary channel by the display driver logic, wherein the auxiliary channel is between the display driver logic and the display logic. The method also detects, by the display driver logic via the auxiliary channel, a required operating mode capability of a display; and determines a minimum number of connection lines needed between the display driver logic and the display logic, to operate the display in the required operating mode capability. A display driver logic includes a connection port suitable for operative connection to a display logic, wherein the display drive logic is operative to detect inactivity between the display driver logic and the display logic, and deactivate an auxiliary channel between the display driver logic and the display logic.

20 Claims, 8 Drawing Sheets

METHOD AND APPARATUS FOR PROVIDING REDUCED POWER USAGE OF A DISPLAY INTERFACE

FIELD OF THE DISCLOSURE

The present disclosure is related to displays and configuration of the displays.

BACKGROUND

Electronic devices today employ a variety of display types such as but not limited to VGA displays. Over the years, various types of displays and display interfaces have been developed, and not all of these display types and interfaces are supported by all devices. The display type supported by a device is normally dependent upon the graphics or video card contained within the device. However, users often have a desire to use the latest display technology and the latest display interface. Therefore, new digital interfaces are being developed and one such interface is the "DisplayPort" (DP) interface. If such common digital interfaces are adopted, older legacy devices would require adapters to conform to the newly adopted interface. Therefore, various handshaking operations to determine configurations for legacy and other devices must be accommodated by any such newly adapted interface. As would be understood, all of these operations require power consumption by the driver device and by the interface. For example, the DP interface uses various channels between the "source" device, such as a personal computer (PC) or the graphics card of a PC, and a "sink" device, such as a display equipment.

The main channel, which delivers video information from the source to the sink consumes the greatest amount of power when operating, and provides various connection lines, or "lanes" that are used to provide video data to the sink device for the appropriate resolution and timing. Handshaking occurs over a handshaking or auxiliary channel, for example the DP AUX CH, to determine the capability of the sink device. The handshaking channel, also consumes power, along with the main video connection lines or lanes.

Therefore, what is needed are methods and apparatuses that perform handshaking and other configuration activities at a minimum power requirement.

The present disclosure provides a method that includes detecting, by a display driver logic, inactivity between the display driver logic and a display logic, and deactivating a handshaking channel by the display driver logic, wherein the handshaking channel is between the display driver logic and the display logic. The method also detects, by the display driver logic via the handshaking channel, a required operating mode capability of the display; and determines a minimum number of connection lines, or DP MAIN lanes, needed between the display driver logic and the display logic, to operate the display in the required operating mode. A display driver logic includes a connection port suitable for operative connection to a display logic, wherein the display drive logic is operative to detect inactivity between the display driver logic and the display logic, and deactivate a handshaking channel between the display driver logic and the display logic.

The present disclosure further provides a computer readable memory, that includes executable instructions for execution by at least one processor, that when executed cause the at least one processor to detect inactivity between a display driver logic and a display logic and deactivate a handshaking channel between said display driver logic and said display logic. The computer readable memory executable instructions, when executed may further cause the one or more processors to detect via the handshaking channel, a required operating mode capability of a display, and determine a minimum number of connection lines needed to operate the display in the required operating mode. The computer readable memory may be any suitable non-volatile memory such as, but not limited to programmable chips such as EEPROMS, flash ROM (thumb drives), compact discs (CDs) digital video disks (DVDs), etc., that may be used to load executable instructions or program code to other electronic devices such as those described in further detail herein below.

Figure 1:
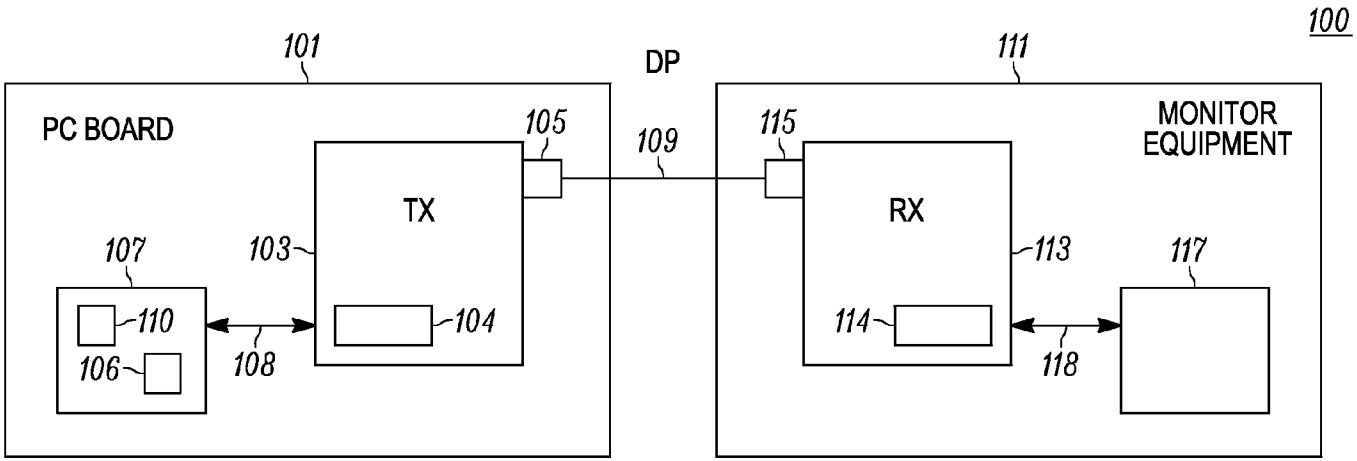
FIG. 1 is a block diagram of a source and sink device having a display driver logic in accordance with the embodiments.
Figure 2:
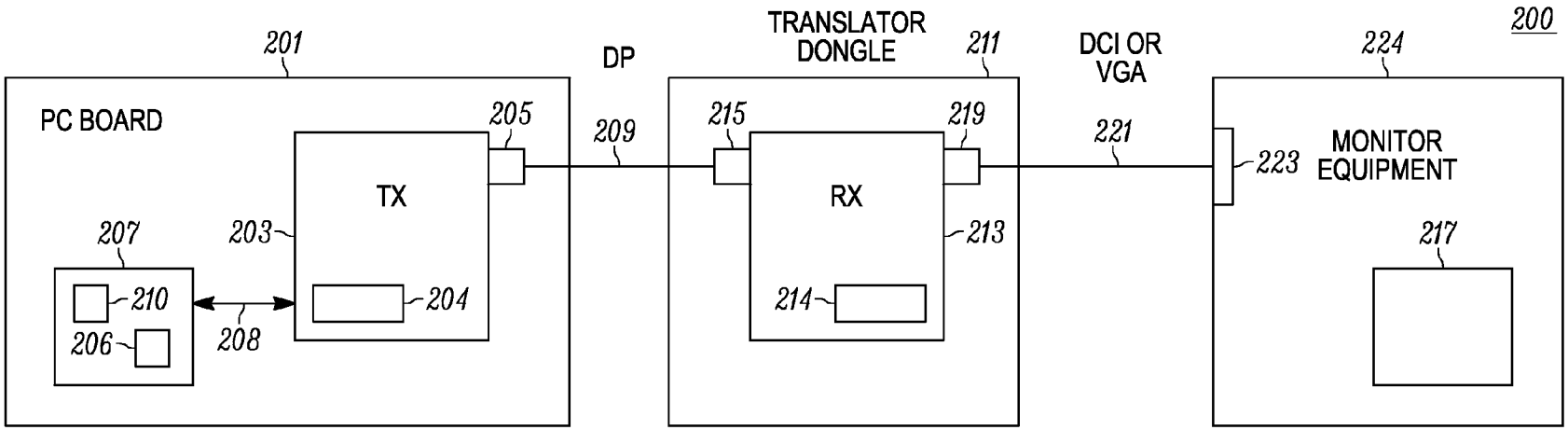
FIG. 2 is a block diagram of a source device and a sink device wherein the sink device is a translator or dongle that connects between the source device and a display equipment. The source device includes a display driver logic in accordance with the embodiments.

The operations of the various embodiments as described in the FIGs. herein, including flowcharts, may be implemented as, or using, various types of logic. The term "logic" as used herein may include software and/or firmware executing on one or more programmable processors, ASICs, DSPs, hardwired logic or combinations thereof. Therefore, in accordance with the embodiments, the various logic and operations of the various flowcharts and the state diagram described herein as FIG. 10, etc., may be implemented in any appropriate fashion as would be understood by one of ordinary skill and would remain in accordance with the embodiments herein disclosed. FIG. 1 and FIG. 2 are block diagrams of a transmitting and receiving devices in accordance with the various embodiments and are illustrative examples of the logic required for implementing the various embodiments.

Turning now to the drawings wherein like numerals represent like components, FIG. 1 illustrates a source device 101 which is coupled to a sink device 111. The source device may be, for example, a personal computer or other electronic device, or maybe a PC board contained within a personal computer. In any case, the source device 101 will include a transmitter 103. The transmitter 103 includes a display driver logic 104 in accordance with an embodiment. The display driver logic 104 may alternatively be a separate logic separate from the transmitter 103 and operatively coupled thereto. The source device 101 also includes a memory 107 which is operably coupled to the transmitter 103. The coupling 108 includes any necessary buses and/or intermediate logic necessary such that the transmitter 103 may access the memory 107. The transmitter 103 may also be a programmable processor that executes code located on memory 107. For example, the display driver logic 104 may interact with memory 107 to access a display driver code 106 in some embodiments. In other words, some embodiments may include the display driver logic 104 which operates independently, whereas in other embodiments the display driver logic 104 may also require a display driver code 106 which it accesses from memory 107 via coupling 108. Additionally the memory 107 may contain user settings 110 for one or more monitors such as monitor equipment 111. The display drive logic 104 may also access the user setting 110 as will be described further herein below.

The sink device 111 in FIG. 1 includes a receiver 113 which may include a "display logic" 114 in accordance with an embodiment. The sink device 111 may actually be a display equipment, that is a monitor equipment, that includes the receiver 113 and also the display logic 114. The display equipment 111 also includes a memory 117 which may in some embodiments store the monitor equipment 111 capability. It is to be understood that the terms "display" and "monitor" are used herein interchangeably, but that the type of display or monitor is not limited thereby. In other words, any type of display or monitor may be used in accordance with the embodiment, such as, but not limited to, RGB, YCBCR444, YCBCR422, capable displays etc. The memory 117 is operably coupled to the receiver 113, and therefore also the display logic 114, via coupling 118. The transmitter 103 includes an output port 105 such that it may be operatively coupled to the receiver 113 and display logic 114. The receiver 113 has a corresponding port 115. The ports 105 and 115 may be pin-outs of an integrated circuit in some embodiments and may also connect directly to an output connector such as, but not limited to, a DisplayPort (DP) connector. A physical coupling 109 which may be, for example, a cable, connects the transmitter port 105 to the receiver port 115. The coupling 109 may provide various interfaces such as, but not limited to, a DP interface as will be described further herein.

Figure 3:
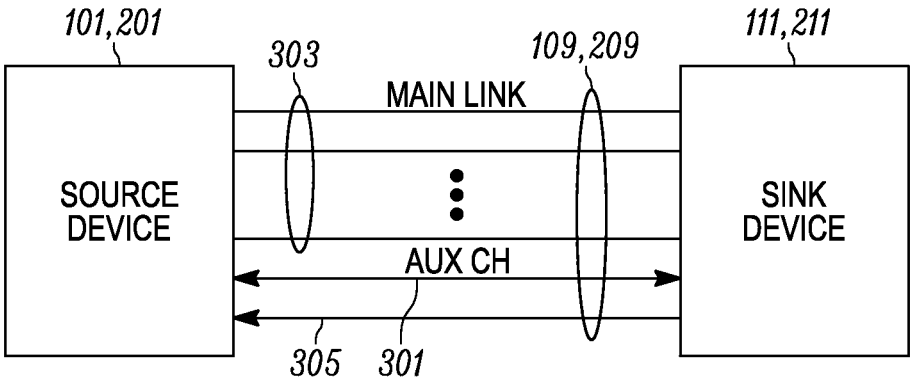
FIG. 3 is a logical block diagram illustrating the channels and connection lines between the source and sink device in accordance with the embodiments.

Turning to FIG. 2, a second embodiment is illustrated wherein a translator 211 is connected between the source device 201 and a display or monitor equipment 224. The translator may, in some embodiments, be a dongle which contains the receiver 213, and which includes the corresponding display logic 214. The source device 201 includes all the features as were described with respect to the source device 101 illustrated in FIG. 1. For example, the source device 201 may be a personal computer or a circuit board residing within a personal computer and includes the transmitter 203. The transmitter 203 includes the display driver logic 204. The transmitter 203 is operatively coupled to the memory 207 via a coupling 208. The memory 207 may also include a display driver code 206, and/or a user settings 210, in some embodiments, similar to what was described with respect to the display driver code 106 and user settings 110 shown in FIG. 1. The transmitter 203 includes a port 205 which is coupled to a port 215 of the receiver 213 via coupling 209. The coupling 209 may provide an interface such as, but not limited to, a DP interface. The receiver 213 also includes a second port 219 for connecting to a port 223 of the display or monitor equipment 224. The second coupling 221 connects the receiver 213 port 219 to the display equipment 224 port 223. The coupling 221 may provide various legacy interfaces such as, but not limited to DVI, HDMI or VGA. Therefore, the receiver 213 may translate between a DP interface on coupling 209 to a legacy interface such as, but not limited to, DVI, HDMI VGA, etc., on coupling 221. Display or monitor equipment 224 may also include a memory 217 which may store display or monitor capabilities in some embodiments. The coupling 109 as shown in FIG. 1 and coupling 209 as shown in FIG. 2 are further described in terms of the logical interface provided thereon in FIG. 3. FIG. 3 generally shows the source device side 101, 201 and the sink device side 111, 211. As was discussed with respect to FIGS. 1 and 2, the sink device may be a display equipment 111 as illustrated in FIG. 1, or may be a translator or dongle 211 as illustrated in FIG. 2. Therefore, in FIG. 3, the interfaces 109 or 209 between the source device 101 or 201 and the sink device 111 or 211 may be a DP interface. The DP interface includes a main link 303 which further includes a plurality of connection lines or "lanes." The interfaces also include a handshaking channel which may be referred to as the auxiliary channel, "AUX CH" 301. A detection line 305 which may be, for example, a hot plug detect line, may also be present in some embodiments. The main link 303 and its corresponding connection lines or lanes provide video or graphic data from the source device to the sink device for the purpose of displaying graphics or video on a monitor or display. The handshaking channel 301 allows the source device to obtain information from the sink device such as configuration information, user settings, or display capabilities such as, but not limited to, resolution capabilities. The resolution capabilities may include, among other things, color depth (both surface color depth and interface color depth), pixel encoding (RGB, YCbCr444, 422, etc.), and timing information. The source device may also send commands to the sink device over the handshaking channel 301. The sink device may also include a register for the purpose of switching operation modes. For example, the sink device may be a display equipment as discussed above. In this case, the display equipment may have an "auxiliary on" or "AUX ON" mode and an "AUX Probing" mode. The display equipment may include a register such that the source device may write a value to the register, and whereby the sink device determines an action based on the value written. For example, the sink device or display equipment may include a register 600. The source device may write a value of 1 or 2 to the register 600. When a value of 1 is written to the register 600, the sink device may respond by powering up. When the source device writes a 2 to the register 600, the sink device may respond by powering down. The register 600, and corresponding values that determine action taken by the sink device, is specified by the DP specifications. However, other registers and other values may also be used to determine various power management states of the sink device in response to values written by the source device or otherwise in response to commands from the source device to the sink device. Therefore, in the various embodiments, the procedure specified by DP may be used between the source device and sink device, however, any appropriate procedures may be used.

Figure 4:
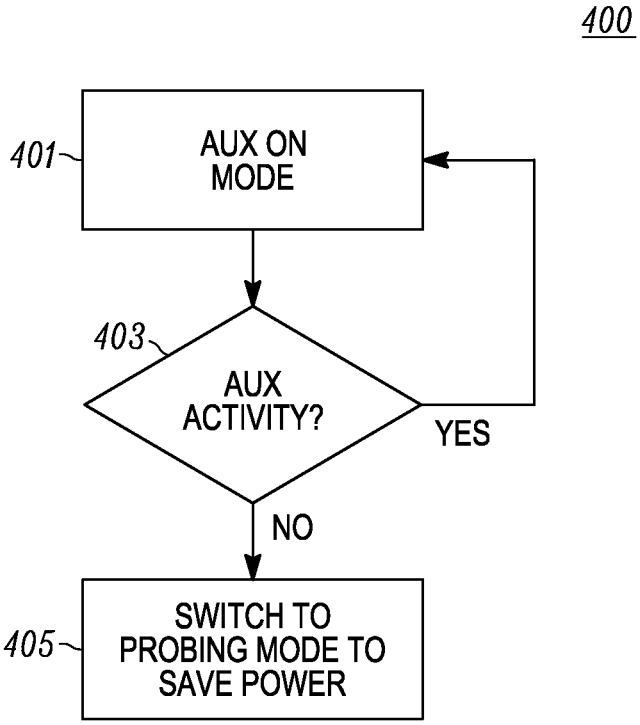
FIG. 4 is a flowchart showing a high level of operation of a display driver logic in accordance with one embodiment, or of a display logic in accordance with another embodiment.

In any case, in the various embodiments, the sink device which may be a display equipment as was discussed previously, will have an AUX ON mode and a probing mode wherein the AUX ON mode allows the source device to actively obtain data from the sink device or send commands to the sink device and receive appropriate responses or replies. The probing mode of the sink device is a lower power mode than the AUX ON mode of the sink device and corresponds to a state in which the sink device is in a low power waiting state, that is, where the sink device is waiting for commands or other information from the source device. Therefore, the sink device consumes more power while in the AUX ON mode than it does when in the probing mode. It is therefore desirable to avoid having the sink device in the AUX ON mode whenever possible. FIG. 4 illustrates a high level of operation of the various embodiments disclosed herein. In FIG. 4, the sink device may be in the AUX mode, that is, the sink device may be in an AUX on state, as illustrated in 401. In one embodiment, the source device 101 or 201 may monitor the AUX activity of the sink device as shown in 403. If AUX activity is present in 403, then the sink device may remain in the AUX mode as in 401. However, if no AUX activity is occurring as checked in 403, then the sink device may switch to a probing mode to save power as illustrated in 405. This is accomplished by the source device 101 or 202, sending a command to the sink device for which the sink device responds by switching to the probing state. In another embodiment, the sink side, via the display logic 114 or 214, monitors the AUX channel and if no AUX activity occurs for a predetermined period of time, the receiver may switch itself into the probing state.

Figure 5:
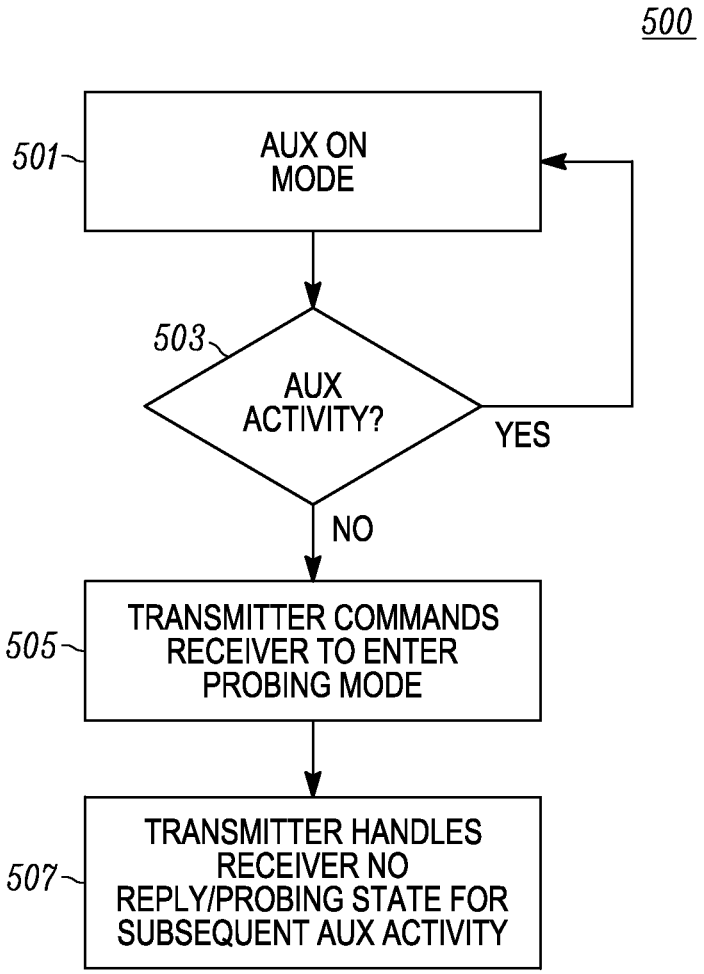
FIG. 5 is a flowchart showing additional operations of a display driver logic on a transmitter side in accordance with an embodiment.

FIG. 5 is a flowchart 500 that provides further details of operation of an embodiment in which the source device, that is, the transmitter side, monitors the AUX channel and commands the receiver to switch to the probing state. In 501, the sink device may be in the AUX mode, that is, the AUX on state. In 503, the transmitter monitors whether any further AUX activity is required. In other words, the transmitter decides whether it requires any additional action or data from the receiver side. If yes, then the receiver (and transmitter) remain in the AUX mode. If no, the transmitter sends a command to the receiver to enter the probing mode as shown in 505. The command may take any suitable form, such as writing a value to a register, such as register 600 for example, as was discussed above. In 507 transmitter will handle any "no reply/probing" state of the receiver for any subsequently required AUX activity. For example, the transmitter may send an AUX channel request, and if no response is received, send a subsequent request after a period of time to allow the receiver to exit probing and once again enter the AUX on state.

Figure 6:
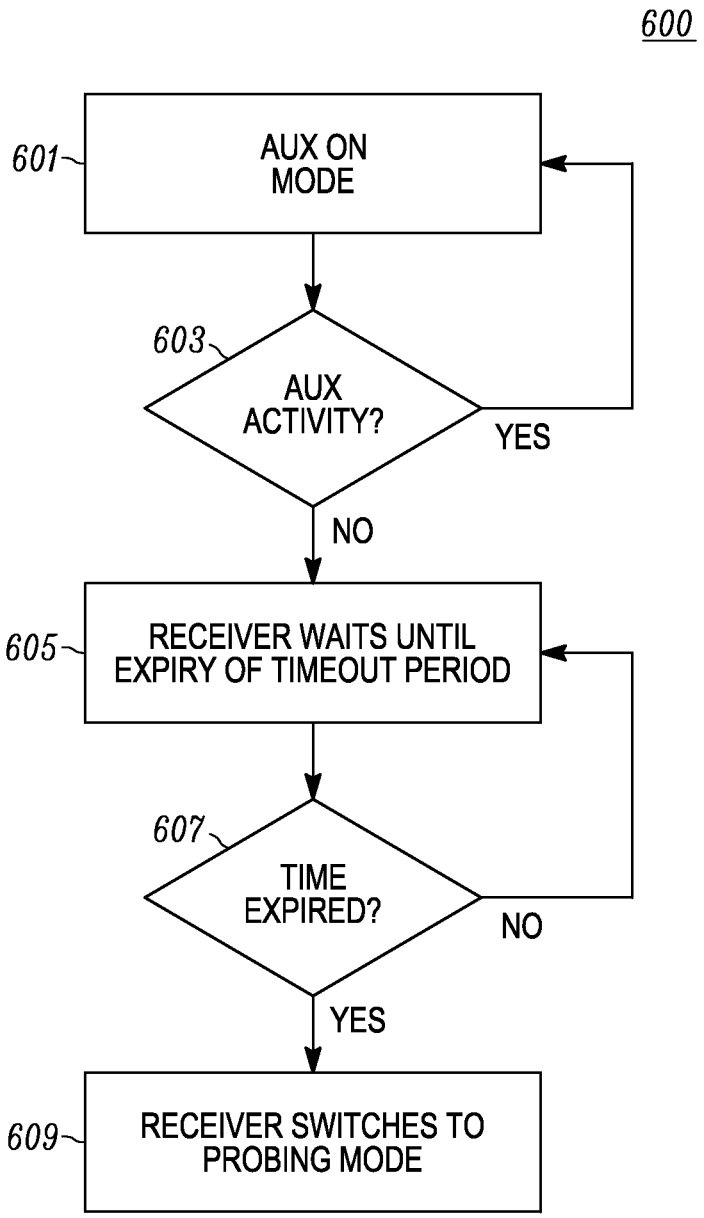
FIG. 6 is a flowchart showing additional operations of a display logic on a receiver side in accordance with an embodiment.

FIG. 6 illustrates another embodiment, where the receiver, independently from the transmitter, monitors AUX activity, by monitoring either its own AUX responses, or by monitoring requests received from the transmitter, or combinations of both. If no AUX activity is detected in 603, the receiver may wait for a predetermined period of time in 605, for example by setting a timer. After expiry of the predetermined time in 607, the receiver switches itself into probing mode as shown in 609. The transmitter side again here may include special handling for the receiver's probing state, if additional AUX activity is subsequently required.

Figure 7:
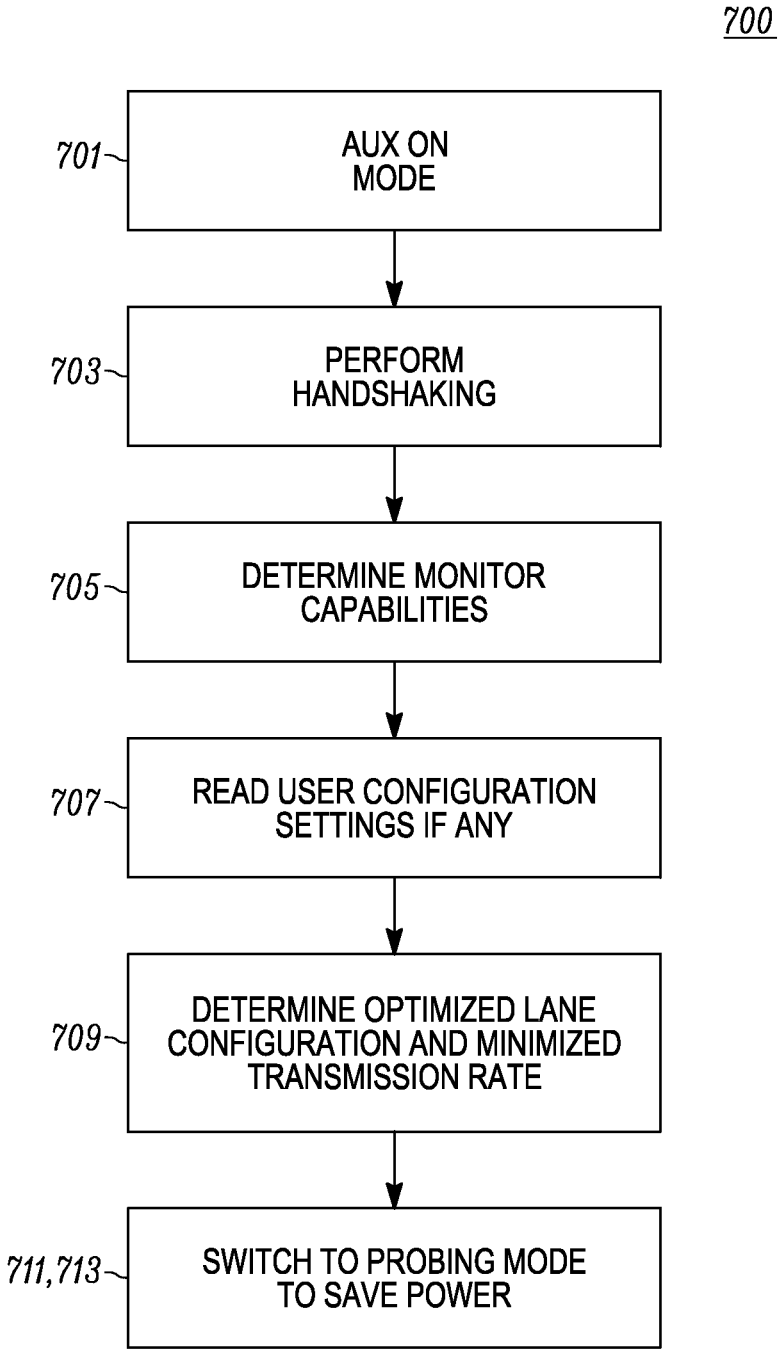
FIG. 7 is a flowchart of operation of a system in accordance with some embodiments.

FIG. 7 illustrates additional details of configuration of lanes in accordance with the various embodiments. In 701 of FIG. 7, the sink device may be in the AUX mode, that is, the AUX on state. In 703, handshaking may be performed between the source device and the sink device. For example, referring to FIG. 1, the transmitter 103 may perform handshaking with the receiver 113 over the coupling 109. As was discussed previously, the coupling 109 may include the AUX CH 301. The handshaking therefore may take place over the AUX CH 301 between the transmitter 103 and the receiver 113. At that time, the transmitter 103 may determine the various display capabilities (117 or 217), such as timing and resolution capabilities, of the display equipment 111 via the receiver 113, as illustrated in 705 of FIG. 7. In some embodiments the display driver logic 104 of the transmitter 103 may also request any user settings 110 stored in the memory 107 of the source device 101 that are related to the display equipment 111 display capabilities or resolution 117. In 709 the display driver logic 104 of the transmitter 103 will determine an optimized lane configuration and minimized transmission rate for video data to the display equipment 111.

For example, as was described with respect to FIG. 3, the main link 303 comprises a plurality of connections lines or lanes. By using one or more lanes or connection lines of the main link 303, various data rates may be obtained in bytes-per-second. As would be understood by one of ordinary skill, the number of lanes in usage, and the timing at which data is transferred, will impact the amount of power consumed by the interface. Therefore it is desirable to operate using the fewest number of connection lines or lanes assuming that the required timing or rate can be achieved. Therefore, the operation in 709 makes a determination that minimizes the number of connection lines, or lanes, used to transmit video or graphics data from the source device to the sink device while achieving the appropriate timing, or rate of data transfer, over the interface. On non-activity of the handshaking channel, the sink device may then switch to the probing mode from the AUX ON mode in order to save power as illustrated in one of either 711 or 713 depending on the particular embodiment. The flowchart 500 operation may occur such that the AUX activity is monitored by the source device, as shown in 503, prior to switching to the probing mode as shown in 713 in FIG. 7. In another embodiment, the receiver side monitors the channel and performs the switch independently of the transmitter as in 711. Details of the 711 receiver side procedure and the 713 transmitter side procedure are provide in FIG. 8 and FIG. 9, respectively. Additionally, the various embodiments may include a combination of the operations illustrated by the flowchart 711 and flowchart 713.

Figure 10:
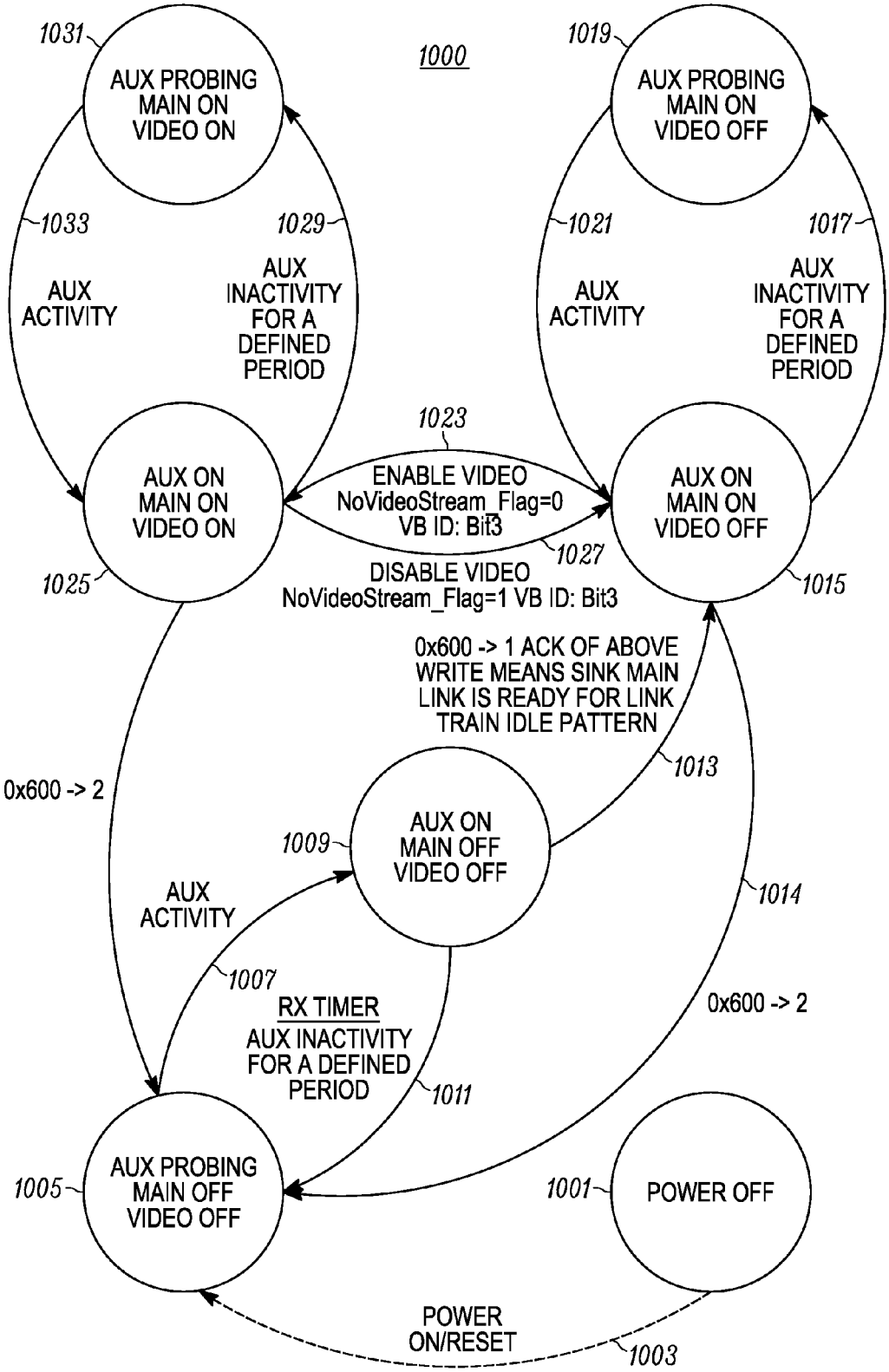
FIG. 10 is a state diagram of a source and sink device in accordance with the embodiments.

FIG. 10 is a state diagram 1000 which illustrates the state of the sink device or display equipment. In FIG. 10 the sink device or display equipment begins in a power-off state 1001. A power on, or reset 1003, places the sink device in an AUX Probing state, where the main link 303 is off, and the video of the display equipment is also off as in 1005. The word "MAIN" as referred to henceforth will refer to the main link 303 illustrated in FIG. 3. Whereas "video," as referred to henceforth, will mean that the display equipment is displaying video thereon as provided by a source device. The sink device or display equipment may switch to an AUX ON state 1009 where the MAIN link and video remain off. An AUX activity 1007 may cause the sink device to switch to the AUX ON state, such that an AUX activity like handshaking may occur. In one embodiment, the source device and a display driver logic will monitor the AUX CH 301 for inactivity, and if the AUX CH 301 remains inactive for a period of time, the display driver logic, such as display driver logic 104 or 204, will send a command to the corresponding receiver to switch the state of the receiver from the AUX ON state to the AUX Probing state. Therefore, the detection of AUX inactivity 1011 changes the state of the sink device, which includes the receiver, from the AUX ON state to the AUX Probing state 1005. As was discussed previously, a register of the sink device, for example register 600, or any other suitable register, may have a value written to it by the source device such that the receiver will take appropriate action. For example, as was discussed previously, a value of 2 may be written to register 600 which will indicate that the sink device should power down. Therefore, various states such as AUX ON, MAIN ON, VIDEO OFF 1015 may be switched to an AUX Probing state 1005 when the source device writes a value of 2 to register 600 as shown by 1014. Likewise, the AUX ON, MAIN ON, VIDEO ON state 1025 may transition to the AUX Probing state 1005 when the source device writes the value of 2 to register 600 as shown by 1008.

When returning to the AUX ON, MAIN OFF, VIDEO OFF state 1009, the source device may begin link training with the sink device as shown by 1013. Prior to this activity, the source device may write a value of 1 to register 600 to indicate to the sink device that the main link 303 should be powered on, that is, the AUX ON, MAIN ON, VIDEO OFF state 1015 should be obtained. For cases where the receiver is placed into a probing state, the transceiver side will, in the various embodiments, employ handling of the probing state (or "no response" state) by, for example, taking appropriate actions to cause the receiver to switch from probing back to an AUX ON mode, so that AUX activity make resume. One approach may be sending an AUX request to the receiver, and waiting for a response for a predetermined period of time, and subsequently sending one or more additional requests until the receiver appropriately recognizes the request and switches from probing back into the AUX ON state.

Thus in some of the various embodiments, the AUX activity will be monitored by the source device. So for example, the AUX ON, MAIN ON, VIDEO OFF states 1015 may transition to the AUX Probing, MAIN ON, VIDEO OFF state 1015 if AUX inactivity is detected as shown by 1017. The AUX activity 1021 however will transition the sink device from the AUX Probing, MAIN ON, VIDEO OFF 1019 state to the AUX ON, MAIN ON, VIDEO OFF 1015 state, by the transceiver's handling of the receiver's probing (i.e. no response) state, as discussed above. From the AUX ON, MAIN ON, VIDEO OFF states 1015, a video stream may be enabled by 1023. The main link 303 is thus active and the monitor or display begins to display video, that is, video is on as shown by the AUX ON, MAIN ON, VIDEO ON 1025 state. Disabling the VIDEO 1027 returns to the AUX ON, MAIN ON, VIDEO OFF state 1015. In the AUX ON, MAIN ON, VIDEO ON 1025 state, AUX activity is also monitored 1029 and if inactivity is detected the sink device is transitioned to the AUX Probing, MAIN ON, VIDEO ON 1031 state. However, AUX activity 1033 will return the sink device to the AUX ON, MAIN ON, VIDEO ON state 1025. As was discussed above, if the source device writes a value of 2 to register 600 as in 1008, the sink device may be transitioned from state 1025 to the AUX Probing, MAIN OFF, VIDEO OFF 1005 state in some cases.

Figure 8:
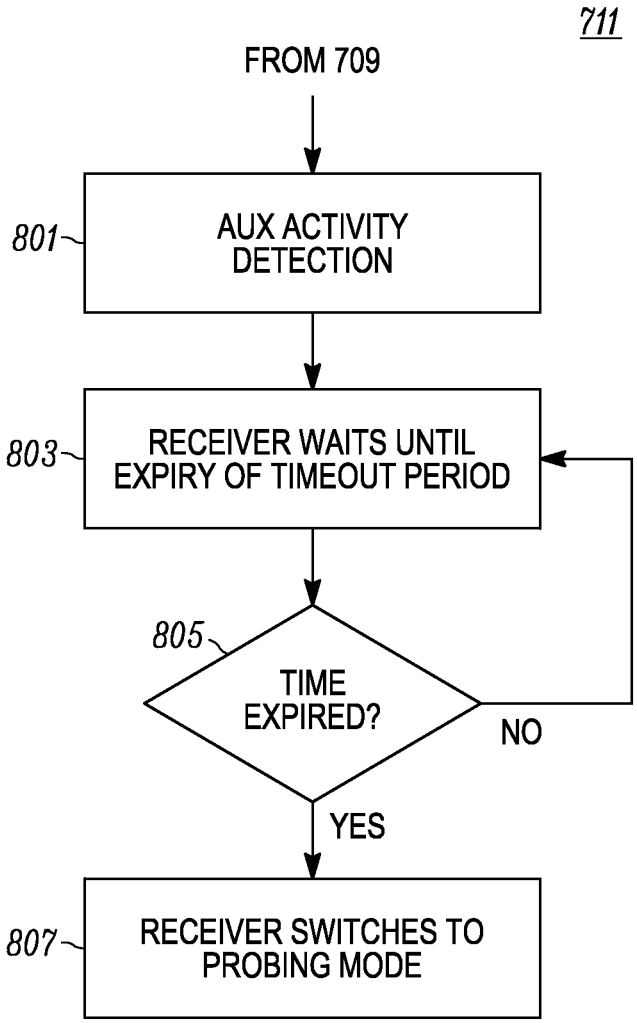
FIG. 8 is a continuation of the flow chart of FIG. 7 for an embodiment where the receiver determines when to switch from an auxiliary on mode to a probing mode.
Figure 9:
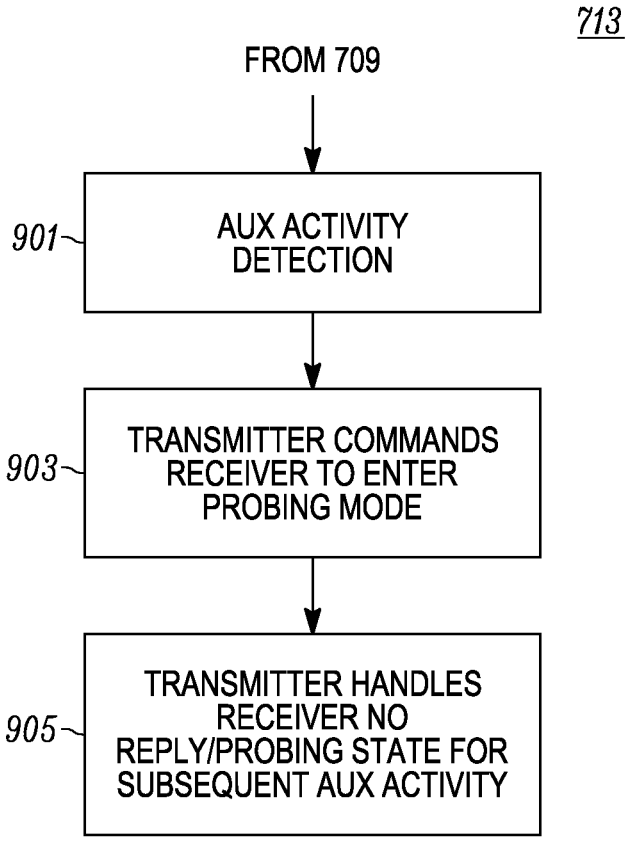
FIG. 9 is a continuation of the flow chart of FIG. 7 for an embodiment where the transmitter determines when to switch the receiver from an auxiliary on mode to a probing mode, by sending a command to the receiver.

In another embodiment, as was discussed with respect to FIG. 6 and FIG. 8, the receiver may monitor its AUX activity and, after a predetermined period of time for which no AUX activity occurs, switch itself from AUX ON to probing, independently of the transmitter.

Therefore, in accordance with the embodiments, for any of various states such as state 1009, state 1015 and state 1025, where the AUX channel is on, the sink device may be transitioned to an AUX Probing state such as the corresponding AUX Probing state 1005, corresponding to state 1009, 1019 corresponding to state 1015, and 1031 corresponding to state 1025. By maintaining the AUX CH 301 in the AUX Probing state when inactivity is detected, power consumption by the AUX CH 301 is reduced. Therefore the overall power consumption by the interfaces on physical connections 109 and 209 is reduced.

Therefore, in summary, the various embodiments will include a source, that is, a transmitter, such as transmitter 103 or 203, that will include a corresponding display driver logic 104 and 204. The display driver logic will establish the link capability of the sink device, that is, a display, and will determine the maximum connection lines or maximum DP lanes and rate that is possible on a given source/cable/sink combination at power up, and will use this information as a means to negotiate a supported timing with an operating system. For example, the source device 101, or source device 201, will also either include, or communicate with, an operating system such as a personal computer operating system. Next the display driver logic, in accordance with the embodiments, will minimize the number of connection lines or lanes necessary to realize a display resolution based on the timing, pixel encoding and color depth that is required. For example, a configuration having the minimum required number of lanes will be selected such that the current timing, interface color depth (i.e. the number of bits required to represent a pixel sent to the display), pixel encoding such as, but not limited to, RGB, YCBCR444, YCBCR422, etc., are used to determine an optimized setting to minimize the number of lanes and the rate required on the main channel. The required resolution and timing may be determined by the display type, for example, a VGA type display or DVI type display, or some other display type, may have a fixed requirement. However, other embodiments may also refer to a user settings such as the user settings 110 or 210 that may be stored in memory 107 or memory 207, respectively. Various combinations of user settings and other requirements, such as monitor equipment capability 117 or 217, may be used to make the determination. For example, if the display supported multiple timings for the same resolution, the display driver logic of the embodiments would automatically select or construct the timing that minimizes the number of connection lines or lanes on the main link 303 that are necessary. The number of connection lines or lanes, as would be understood by one of ordinary skill, directly impacts power usage. For example, one lane would use less power than a two lane configuration. Further, the display driver logic of some embodiments will command a sink device, such as a display equipment 111 or a translator device 211, to power down its main link 303 and put its AUX CH 301 in probing mode whenever the interface is not in use. In other embodiments, the sink device will power itself down by placing its AUX CH in probing mode, independently of the source device. It is to be understood that this could occur during a mode change, a monitor time out, or a complete turning off of the interface running on coupling 109 or coupling 209. That is, a transition from an AUX ON, MAIN ON, VIDEO ON to an AUX Probing, MAIN OFF, VIDEO OFF state as was discussed with respect to FIG. 10. For any subsequent AUX activity, the display driver logic of the embodiments will ensure that it handles a "no response" AUX channel reply by repeating the AUX transaction until the sink device, or the receiver that includes the AUX monitoring logic, replies with an acknowledgment "ACK." This AUX response is not limited to the DPCD address 0X600 as described, for example, in the DP specification. That is, in the various embodiments, if the source powers down the interface link, then on subsequent link training operations, it will command the sink to power up to ensure the sink main link can be powered up prior to the link training process. The display driver logic of the embodiments will wait for acknowledgment of power up before proceeding. Further, a sink device, such as the display equipment 111 illustrated in FIG. 1 or the translator 211 illustrated in FIG. 2, will operate in accordance with the state diagram 1000 illustrated in FIG. 10 such that if AUX inactivity occurs for a predefined period of time, the sink device will automatically enter the lower power probing mode.

The devices herein described, in accordance with the various embodiments, may, in whole or in part, be the result of the processing of hardware description language (HDL) instructions and/or data. That is, the HDL instructions and/or data may be used to configure a manufacturing process to manufacture a programmable processor (and/or "logic" as described herein) such that when the programmable processor (and/or "logic"), when configured (through the use of software and/or firmware) is operable to perform the methods in accordance with the embodiments herein disclosed. Such HDL code (or a Netlist) may be stored on a computer readable medium such as, but not limited to, a server memory, CD, DVD, or other non-volatile memory that may provide code to be executed by one or more processors of the manufacturing process.

Other variations that would be equivalent to the herein disclosed embodiments may occur to those of ordinary skill in the art and would remain in accordance with the spirit and scope of embodiments as defined herein by the following claims.

What is claimed is:

1. A method comprising:

detecting, by display driver logic, inactivity on an auxiliary channel between said display driver logic and display logic when a main link is on;

deactivating said auxiliary channel by said display driver logic;

wherein deactivating said auxiliary channel by said display driver logic, comprises:

sending a request by said display driver logic to said display logic requesting that said display logic enter a low power state on said auxiliary channel; and leaving the main link on when the auxiliary channel is deactivated.

2. The method of claim 1, further comprising:

detecting, by said display driver logic via said auxiliary channel between said display driver logic and said display logic, a required operating mode capability of a display; and determining a minimum number of connection lines needed, said connection lines connected between said display driver logic and said display logic, to operate said display in said required operating mode capability.

3. The method of claim 2, wherein detecting, by said display driver logic via said auxiliary channel between said display driver logic and said display logic, a required operating mode capability of a display, comprises:

detecting a required resolution and a rate of said display.

4. The method of claim 3, wherein determining a minimum number of connection lines needed, further comprises:

determining said minimum number of connection lines needed in combination with a minimum rate based on said required resolution, wherein said required resolution includes a required color depth of said display.

5. The method of claim 1, wherein deactivating said auxiliary channel by said display driver logic, comprises:

writing, by said display driver logic, a value to a register of said display logic, wherein said display logic enters the low power state in response to said value written to said register.

6. The method of claim 2, wherein detecting, by said display driver logic via said auxiliary channel between said display driver logic and said display logic, a required operating mode capability of a display, comprises:

detecting a required resolution including a required color depth and pixel encoding, and a plurality of rates of said display; and wherein determining a minimum number of connection lines needed, further comprises:

determining said minimum number of connection lines needed in combination with a minimum rate selected from said plurality of rates, based on said required color depth of said display.

7. A method comprising:

detecting, by display logic, inactivity on a handshaking auxiliary channel between display driver logic and said display logic when a main link is on;

entering a probing state on said auxiliary channel by said display logic in response to expiry of a time interval in which no further activity is detected by said display logic on said auxiliary channel; and leaving the main link on when the auxiliary channel is in the probing state.

8. A source device, comprising:

a connection port suitable for operative connection to a display logic; and display driver logic, operative to deactivate a handshaking auxiliary channel between said display driver logic and said display logic, in response to inactivity on said auxiliary channel during a main link ON condition.

9. The source device of claim 8, wherein said display driver logic is further operative to:

detect via said auxiliary channel, a required operating mode capability of a display; and determine a minimum number of connection lines needed, said connection lines connectable between said display driver logic and said display logic, to operate said display in said required operating mode capability.

10. The source device of claim 8, wherein said display driver logic is further operative to detect a required operating mode capability of a display by detecting a required resolution and a rate of said display.

11. The source device of claim 10, wherein said display driver logic is further operative to determine a minimum number of connection lines needed by determining said minimum number of connection lines needed in combination with a minimum rate based on said required resolution, wherein said required resolution includes a required color depth and pixel encoding of said display.

12. The source device of claim 8, wherein said display driver logic is further operative to deactivate said auxiliary channel by sending a request to said display logic requesting that said display logic enter a probing state on said auxiliary channel.

13. The source device of claim 8, wherein said display driver logic is further operative to deactivate said auxiliary channel by writing a value to a register of said display logic, wherein said display logic enters a probing state on said auxiliary channel in response to said value written to said register.

14. The source device of claim 9, wherein said display driver logic is further operative to detect a required operating mode capability of a display by:

detecting a required resolution including a required color depth, and a plurality of rates of said display; and wherein determining a minimum number of connection lines needed, further comprises:

determining said minimum number of connection lines needed in combination with a minimum rate selected from said plurality of rates, based on said required color depth of said display.

15. A sink device, comprising:

a connection port suitable for operative connection to a display driver logic; and display logic, operative to enter a probing state on a handshaking auxiliary channel in response to expiry of a time interval in which no activity between said display driver logic and said display logic is detected by said display logic on said auxiliary channel, when a main link is on.

16. A non-transitory computer readable memory comprising:

executable instructions for execution by at least one processor, that when executed cause said at least one processor to:

detect inactivity between a display driver logic and a display logic when a main link is on;

deactivate an auxiliary channel between said display driver logic and said display logic; and wherein deactivating said auxiliary channel by said display driver logic, comprises:

sending a request by said display driver logic to said display logic requesting that said display logic enter a low power state on said auxiliary channel; and leave a main link on when the auxiliary channel is deactivated.

17. The computer readable memory of claim 16, wherein said executable instructions, when executed further cause the one or more processors to:

detect via said auxiliary channel between said display driver logic and said display logic, a required operating mode capability of a display; and determine a minimum number of connection lines needed, said connection lines connected between said display driver logic and said display logic, to operate said display in said required operating mode capability.

18. The computer readable memory of claim 17, wherein said executable instructions, when executed further cause the one or more processors to:

detect inactivity on said minimum number of connection lines; and deactivate said minimum number of connection lines.

19. The computer readable memory of claim 16, wherein said executable instructions comprise hardware description language instructions.

20. The method of claim 1 comprising detecting inactivity on an auxiliary channel when a main link is on and when there is a video on or video off state.

* * * * *